United States Patent [19]

Feldmahr et al.

[11] 4,423,976

[45] Jan. 3, 1984

[54] SHEET LIFTER

[75] Inventors: Walter Feldmahr, Northbrook; Kenneth H. Oberg, Buffalo Grove, both of Ill.

[73] Assignee: Acco World Corporation, Wheeling, Ill.

[21] Appl. No.: 287,702

[22] Filed: Jul. 28, 1981

Related U.S. Application Data

[63] Continuation of Ser. No. 90,320, Nov. 1, 1979, abandoned.

[51] Int. Cl.[3] ..... B42F 13/10

[52] U.S. Cl. ..... 402/80 L; 402/24

[58] Field of Search ..... 402/24, 37, 38, 39, 402/80 L, 80 P

[56] References Cited

U.S. PATENT DOCUMENTS

| | | | |
|---|---|---|---|
| 1,741,066 | 12/1929 | Morgan | 402/79 X |
| 1,894,241 | 1/1933 | Raynolds | 402/39 X |
| 1,959,858 | 5/1934 | Dawson | 402/37 |
| 1,964,252 | 6/1934 | Dawson | 402/80 L |
| 2,647,518 | 8/1953 | Panfil, Sr. | 402/80 L |
| 3,191,604 | 6/1965 | Wance | 402/39 |
| 3,306,301 | 2/1967 | Mason | 402/38 |
| 3,366,118 | 1/1968 | Beyer | 402/80 L |
| 3,493,310 | 2/1970 | Orth et al. | 402/24 |
| 3,936,201 | 2/1976 | Kenny et al. | 402/80 L X |

*Primary Examiner*—E. R. Kazenske
*Assistant Examiner*—Brown: John S.
*Attorney, Agent, or Firm*—Willian, Brinks, Olds, Hofer, Gilson & Lione, Ltd.

[57] ABSTRACT

An improved sheet lifter is disclosed. The sheet lifter includes a lower edge having inner and outer ends, an inner edge extending upwardly from the inner end of the lower edge in a direction substantially perpendicular thereto, and an outer edge extending upwardly and inwardly from the outer end of the lower edge at an angle of from 70 to 184 degrees.

18 Claims, 5 Drawing Figures

SHEET LIFTER

This application is a continuation of application Ser. No. 090,320, filed Nov. 1, 1979, now abandoned.

BACKGROUND OF THE INVENTION

The invention relates to sheet lifters to be used with ringed notebooks.

Sheet lifters have been used for many years with ringed notebooks. Conventional sheet lifters are generally rectangular in shape, and are normally positioned adjacent the front and back covers of the notebook. When the front pages of the notebook are turned, the front sheet lifter begins to roll over with the turning of the pages. However, while rolling over, the sheet lifter is providing support to the inner portion of the front pages, thus preventing them from doubling over themselves which could bring about difficulty in turning and resulting damage to the pages. The term "inner" as used herein is, of course, intended to refer to the edge which is closest to the rings of the notebook. "Outer" therefore means remote from the rings. The terms "upper" and "lower" will be used to refer to the top and bottom ends of the sheet lifter, the notebook, or the sheets or pages held thereby.

By providing support to the sheets in this fashion, conventional sheet lifters often are successful in preventing damage to the sheets. However, conventional lifters are sometimes inadequate, particularly for use with light weight paper or in larger notebooks with many bound pages. One reason for such inadequacy is that the pages tend to turn over all three rings at the same time, thereby compounding the resistance offered by any single ring.

It is therefore a goal of the present invention to provide a sheet lifter which performs in a superior fashion. It is also desirable than such improved sheet lifter cost no more than conventional sheet lifters. These and other objects, features and advantages of the present invention will be apparent from the following description, appended claims and annexed drawings.

SUMMARY OF THE INVENTION

This invention responds to the shortcomings present in conventional designs by providing a sheet lifter having a lower edge with inner and outer ends, an inner edge extending upwardly from the inner end of the lower edge in a direction substantially perpendicular thereto, and an outer edge extending upwardly and inwardly from the outer end of the lower edge at an angle of from 70 to 84 degrees. The sheet lifter may include an upper edge, substantially parallel to the lower edge, extending between the inner and outer edges. Alternatively, the inner and outer edges intersect so that the sheet lifter is generally in the form of a right angle triangle.

The corners of the sheet lifter are normally rounded in order to minimize wear and possibly reduce production costs. However, this is conventional feature. Therefore, for the purpose of simplification in this discussion, the angles formed by the intersection of the various edges will be discussed as though they are sharp or squared and not rounded.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
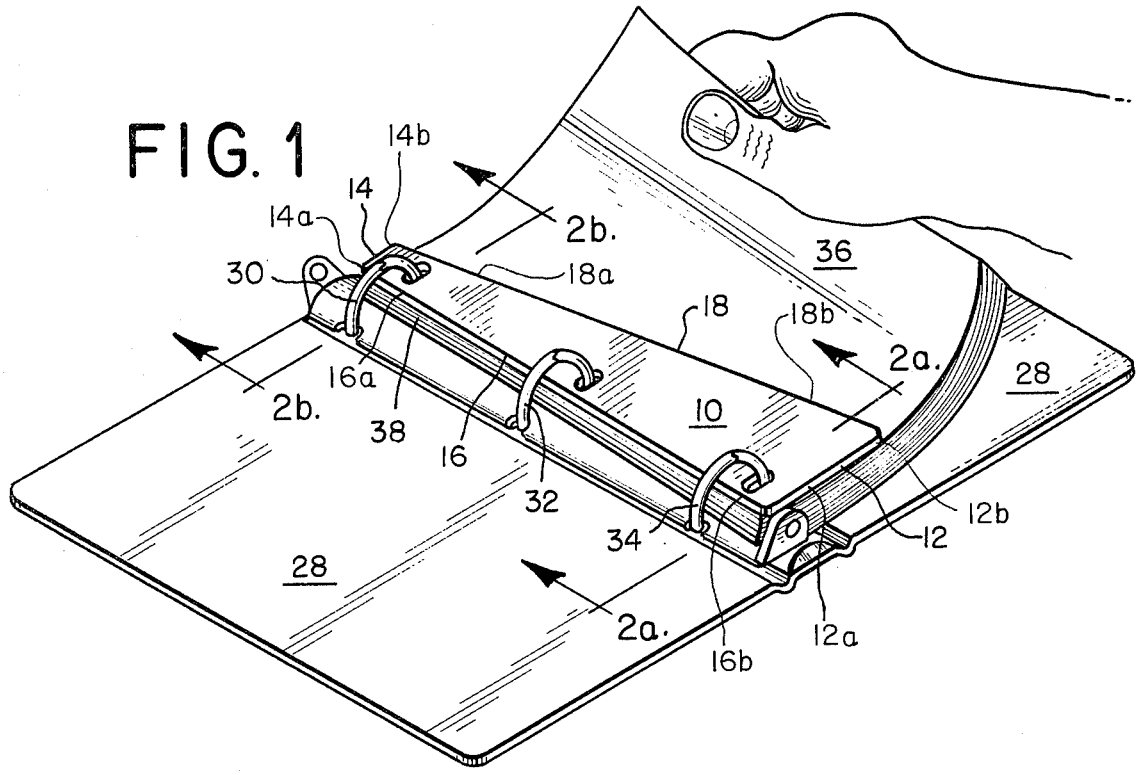
FIG. 1 is a perspective view of an open looseleaf notebook utilizing a first embodiment of the invention, showing the position of the sheet lifter as the pages are being lifted to be turned.
Figure 2A:
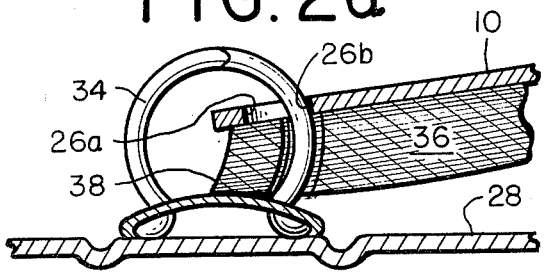
FIG. 2*a* is a sectional view taken along line 2*a*—2*a* of FIG. 1.
Figure 2B:
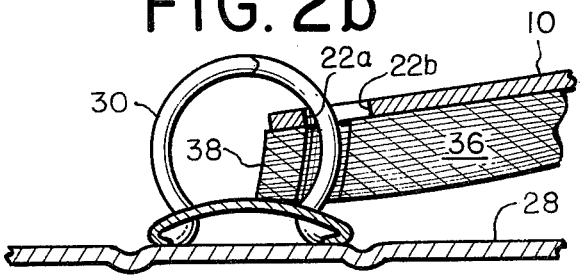
FIG. 2*b* is a sectional view taken along line 2*b*—2*b* of FIG. 2.
Figure 3:
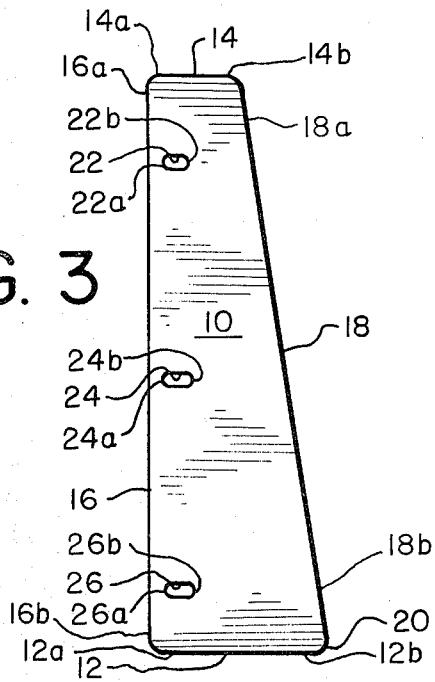
FIG. 3 is a front elevation view of the first embodiment of the invention.

In one form of the invention chosen for the purpose of illustration in FIGS. 1–3, the sheet lifter is generally indicated by the numeral 10. It includes substantially parallel lower and upper edges 12 and 14, and inner and outer edges 16 and 18. The upper and lower edges 12 and 14 each include inner and outer ends which are indicated with the numerals 12*a* or 14*a*, and 12*b* or 14*b*, respectively. The inner and outer edges 16 and 18 each include upper and lower ends 16*a* or 18*a*, and 16*b* or 18*b*, respectively.

The lower and upper edges 12 and 14 are normally horizontal with the sheet lifter 10 in its operating position in a looseleaf notebook. The inner edge 16 preferably extends perpendicularly between the inner ends of the lower and upper edges 12*a* and 14*a*, respectively. The outer edge 18 extends between the outer ends of the lower and upper edges 12*b* and 14*b*, respectively.

The angle 20 defined by the intersection of the lower edge 12 and the outer edge 18 is between 70 and 84 degrees. It has been found that this is the optimal range for achieving the advantages attained by the present invention. As mentioned above, however, angle 20 is typically rounded as are the other corners of the sheet lifter 10.

The sheet lifter 10 also normally includes holes, three of which are shown in the depicted embodiment, labeled with the numerals 22, 24 and 26. The inner and outer edges of holes 22, 24 and 26 are identified as 22*a* and 22*b*, 24*a* and 24*b*, and 26*a* and 26*b*, respectively. These holes 22, 24 and 26 are somewhat oblong, as in some conventional sheet lifters. The sheet lifter 10 is thereby made particularly well suited for use in a looseleaf ringed notebook 28, with binding rings 30, 32 and 34, as shown in FIG. 1.

The sheet lifter 10 is constructed of relatively rigid material as is well known in the art, and is manufactured in a conventional fashion using state of the art technology. The term "relatively rigid" is intended to define material which is substantially more rigid than a single sheet of paper 36 with which the sheet lifter 10 is to be used. Having such properties, the sheet lifter 10 is sufficiently rigid to support the notebook sheets 36 as they are being turned.

The operation of the sheet lifter 10 will now be described. Reference is made primarily to FIG. 1 which depicts a plurality of sheets 36 held in the notebook 28 in a partially-turned condition.

When the notebook 28 is opened with the sheets 36 lying flat on the right side of the notebook rings 30, 32 and 34, the sheet lifter 10 will be positioned immediately over the sheets 36 with the inner edge 16 of the sheet lifter 10 corresponding to the inner edges 38 of the individual sheets 36.

When the user begins to turn a group of sheets 36 to the position depicted in FIG. 1, the sheet lifter 10 shifts laterally in a clockwise direction as shown in FIG. 1. The oblong configuration of the holes 22, 24 and 26 permits such lateral movement. The clockwise shift in the sheet lifter 10 is caused by the action of the sheets 36 on the lower end 18*b* of the outer edge 18 which, due to the angular configuration of the outer edge 18, will be contacted prior to the upper end 18*a* of the outer edge 18.

The shifted condition is perhaps best shown in the sectional views of FIGS. 2*a* and 2*b*. The section in FIG. 2*a* is taken across the bottom hole 26, and depicts the outer edge 26*b* of the bottom hole 26 abutting the bottom ring 34. The section in FIG. 2*b*, on the other hand, is taken across the top hole 22. The inner edge 22*a* of the top hole 22 can be seen in FIG. 2*b* to abut the top ring 30.

This clockwise shift of the sheet lifter 10 will tend to induce, by friction, a similar, although less exaggerated, shift of at least the top several sheets 36 beneath the sheet lifter 10. Thus, as the turning of the sheets 36 is continued, the sheet lifter 10 and the sheets 36 will have a tendency to turn more readily over the rings 30, 32 and 34 since they are turning over a single ring at a time. At the same time, the sheet lifter 10 performs its conventional function of preventing the sheets 36 from doubling over themselves rather than turning.

When the sheet lifter 10 and the sheets 36 are substantially all of the way turned, they will automatically resume their initial upright position without any additional effort by the user.

Figure 4:
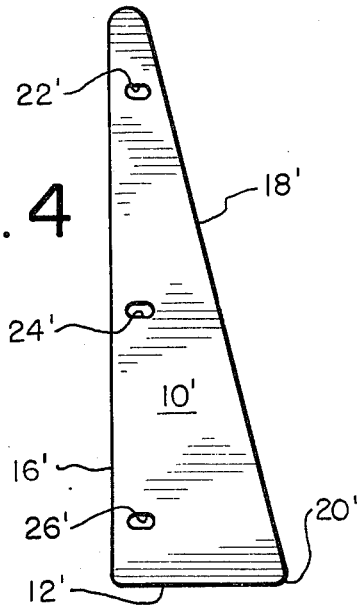
FIG. 4 is a front elevation view of a second embodiment of the invention.

FIG. 4 depicts a second embodiment of the invention wherein the sheet lifter has only three edges, rather than four. Parts in this second embodiment which correspond to those in the first embodiment shown in FIGS. 1–3 are indicated with the same numerals, except that they are primed. For example, the sheet lifter is identified with the numeral 10', having lower, inner and outer edges 12', 16', and 18', respectively. Three oblong holes 22', 24' and 26' are also depicted, as with the first embodiment. The angle 20' between the lower and outer edges, 12' and 18', is similarly between 70 and 84 degrees. The operation of this second embodiment 10' is identical to that of sheet lifter 10.

Of course, it should be understood that various changes and modifications in the preferred embodiments described herein will be apparent to those skilled in the art. Such changes and modifications can be made without departing from the spirit and scope of the present invention and without diminishing its attendant advantages. It is, therefore, understood that such changes and modifications be covered by the following claims.

I claim:

1. An improved binder comprising:

a front cover;

a back cover;

a spine connecting said back cover to said front cover;

a plurality of rings mounted on said spine for holding sheets placed therein; and, a sheet lifter adjacent said front cover comprising a surface having an inner edge, an outer edge and a lower edge with inner and outer ends, said inner edge being contiguous to said inner end and substantially perpendicular to said lower edge, said outer edge being contiguous to said outer end and forming an angle between 70 and 84 degrees with respect to said lower edge, said inner edge extending substantially the length of the sheets placed in the binder and said lower edge extending only a portion of the distance across said sheets, said surface having a plurality of holes along its inner edge, said rings extending through said holes such that when said binder is closed said sheet lifter facilitates the movement of sheets inserted in said binder over said rings so as to prevent damage to said sheets.

2. The improved binder of claim 1 wherein said inner edge terminates at an inside end and said outer edge terminates at an outside end and wherein said inside end and said outside end are connected by an upper edge.

3. The improved binder of claim 2 wherein said holes are shaped to allow said surface to be shifted laterally with respect to said binder rings.

4. The improved binder of claim 3 wherein said holes are oblong in a direction substantially perpendicular to said inner edge.

5. The improved binder of claim 1 wherein said inner and outer edges intersect, forming an intersect end, and wherein said inner end, said outer end, and said intersect end are rounded so that said surface is generally in the form of a right angle triangle with rounded corners.

6. The improved binder of claim 5 wherein said holes are shaped to allow said surface to be shifted laterally with respect to said binder rings.

7. The improved binder of claim 6 wherein said holes are oblong in a direction substantially perpendicular to said inner edge.

8. The improved binder of claim 1 wherein said holes are shaped to allow said surface to be shifted laterally with respect to said binder rings.

9. The improved binder of claim 8 wherein said holes are oblong in a direction substantially perpendicular to said inner edge.

10. An improved binder comprising:

a front cover;

a back cover;

a spine connecting said back cover to said front cover;

a plurality of rings mounted on said spine for holding sheets placed therein; and, a sheet lifter adjacent said back cover comprising a surface having an inner edge, an outer edge and a lower edge with inner and outer ends, said inner edge being contiguous to said inner end and substantially perpendicular to said lower edge, said outer edge being contiguous to said outer end and forming an angle between 70 and 84 degrees with respect to said lower edge, said inner edge extending substantially the length of the sheets placed in said binder and said lower edge extending only a portion of the distance across said sheets, said surface having a plurality of holes along its inner edge, said rings extending through said holes such that when said binder is closed said sheet lifter facilitates the movement of sheets inserted in said binder over said rings so as to prevent damage to said sheets.

11. The improved binder of claim 10 wherein said inner edge terminates at an inside end and said outer edge terminates at an outside end and wherein said inside end and said outside end are connected by an upper edge.

12. The improved binder of claim 11 wherein said holes are shaped to allow said surface to be shifted laterally with respect to said binder rings.

13. The improved binder of claim 12 wherein said holes are oblong in a direction substantially perpendicular to said inner edge.

14. The improved binder of claim 10 wherein said inner and outer edges intersect, forming an intersect end, and wherein said inner end, said outer end, and said intersect end are rounded so that said surface is generally in the form of a right angle triangle with rounded corners.

15. The improved binder of claim 14 wherein said holes are shaped to allow said surface to be shifted laterally with respect to said binder rings.

16. The improved binder of claim 15 wherein said holes are oblong in a direction substantially perpendicular to said inner edge.

17. The improved binder of claim 10 wherein said holes are shaped to allow said surface to be shifted laterally with respect to said binder rings.

18. The improved binder of claim 17 wherein said holes are oblong in a direction substantially perpendicular to said inner edge.

* * * * *

UNITED STATES PATENT AND TRADEMARK OFFICE

CERTIFICATE OF CORRECTION

PATENT NO. : 4,423,976

DATED : January 3, 1984

INVENTOR(S) : Walter Feldmahr and Kenneth H. Oberg

It is certified that error appears in the above-identified patent and that said Letters Patent is hereby corrected as shown below:

Cover page, right hand column, delete commas in name of attorneys

Cover page, Abstract, last line, change -- 184 -- to "84"

Signed and Sealed this

*Third* Day of *December 1985*

[SEAL]

*Attest:*

DONALD J. QUIGG

*Attesting Officer*

*Commissioner of Patents and Trademarks*